US006236966B1

(12) United States Patent
Fleming

(10) Patent No.: US 6,236,966 B1
(45) Date of Patent: May 22, 2001

(54) SYSTEM AND METHOD FOR PRODUCTION OF AUDIO CONTROL PARAMETERS USING A LEARNING MACHINE

(76) Inventor: Michael K. Fleming, 1181 Davis St., Redwood City, CA (US) 94061

( * ) Notice: Subject to any disclaimer, the term of this patent is extended or adjusted under 35 U.S.C. 154(b) by 0 days.

(21) Appl. No.: 09/291,790

(22) Filed: Apr. 14, 1999

Related U.S. Application Data

(60) Provisional application No. 60/081,750, filed on Apr. 14, 1998.

(51) Int. Cl.[7] ..... G10L 13/00
(52) U.S. Cl. ..... 704/259
(58) Field of Search ..... 704/258, 259, 704/232, 266

(56) References Cited

U.S. PATENT DOCUMENTS 5,924,066 * 7/1999 Kundu ..... 704/232
5,940,797 * 8/1999 Abe ..... 704/260
6,019,607 * 2/2000 Jenkins et al. ..... 434/116

* cited by examiner

*Primary Examiner*—Richemond Dorvil
*Assistant Examiner*—Susan Wieland
(74) *Attorney, Agent, or Firm*—Lumen Intellectual Property Services, Inc.

(57) ABSTRACT

A method and device for producing audio control parameters from symbolic representations of desired sounds includes presenting symbols to multiple input windows of a learning machine, where the multiple input windows comprise a lowest window, a higher window, and possibly additional higher windows. The symbols presented to the lowest window represent audio information having a low level of abstraction (e.g., phonemes), and the symbols presented to the higher window represent audio information having a higher level of abstraction (e.g., words or phrases). The learning machine generates parameter contours and temporal scaling parameters from the symbols presented to the multiple input windows. The parameter contours are then temporally scaled in accordance with the temporal scaling parameters to produce the audio control parameters. The techniques can be used for text-to-speech, for music synthesis, and numerous other applications.

29 Claims, 8 Drawing Sheets

SYSTEM AND METHOD FOR PRODUCTION OF AUDIO CONTROL PARAMETERS USING A LEARNING MACHINE

CROSS-REFERENCE TO RELATED APPLICATIONS

This application claims priority from U.S. Provisional Patent Application No. 60/081,750 filed Apr. 14, 1998, which is incorporated herein by reference.

FIELD OF THE INVENTION

This invention relates to the field of audio synthesis, and in particular to systems and methods for generating control parameters for audio synthesis.

BACKGROUND OF THE INVENTION

The field of sound synthesis, and in particular speech synthesis, has received less attention historically than fields such as speech recognition. This may be because early in the research process, the problem of generating intelligible speech was solved, while the problem of recognition is only now being solved. However, these traditional speech synthesis solutions still suffer from many disadvantages. For example, conventional speech synthesis systems are difficult and tiring to listen to, can garble the meaning of an utterance, are inflexible, unchanging, unnatural-sounding and generally 'robotic' sounding. These disadvantages stem from difficulties in reproducing or generating the subtle changes in pitch, cadence (segmental duration), and other vocal qualities (often referred to as prosodics) which characterize natural speech. The same is true of the transitions between speech segments themselves (formants, diphones, LPC parameters, etc.).

The traditional approaches in the art to generating these subtler qualities of speech tend to operate under the assumption that the small variations in quantities such as pitch and duration observed in natural human speech are just noise and can be discarded. As a result, these approaches have primarily used inflexible methods involving fixed formulas, rules and the concatenation of a relatively small set of prefigured geometric contour segments. These approaches thus eliminate or ignore what might be referred to as microprosody and other microvariations within small pieces of speech.

Recently, the art has seen some attempts to use learning machines to create more flexible systems which respond more reasonably to context and which generate somewhat more complex and evolving parameter (e.g., pitch) contours. For example, U.S. Pat. No. 5,668,926 issued to Karaali et al. describes such a system. However, these approaches are also flawed. First, they organize their learning architecture around fixed-width time slices, typically on the order of 10 ms per time slice. These fixed time segments, however, are not inherently or meaningfully related to speech or text. Second, they have difficulty making use of the context of any particular element of the speech: what context is present is represented at the same level as the fixed time slices, severely limiting the effective width of context that can be used at one time. Similarly, different levels of context are confused, making it difficult to exploit the strengths of each. Additionally, by marrying context to fixed-width time slices, the learning engine is not presented with a stable number of symbolic elements (e.g., phonemes or words.) over different patterns.

Finally, none of these models from the prior art attempt application of learning models to non-verbal sound modulation and generation, such as musical phrasing, non-lexical vocalizations, etc. Nor do they address the modulation and generation of emotional speech, voice quality variation (whisper, shout, gravelly, accent), etc.

SUMMARY OF THE INVENTION

In view of the above, it is an object of the present invention to provide a system and method for the production of prosodics and other audio control parameters from meaningful symbolic representations of desired sounds. Another object of the invention is to provide such a technique that avoids problems associated with using fixed-time-length segments to represent information at the input of the learning machine. It is yet another object of the invention to provide such a system that takes into account contextual information and multiple levels of abstraction.

Another object of the invention is to provide a system for the production of audio control parameters which has the ability to produce a wide variety of outputs. Thus, an object is to provide such a system that is capable of producing all necessary parameters for sound generation, or can specialize in producing a subset of these parameters, augmenting or being augmented by other systems which produce the remaining parameters. In other words, it is an object of the invention to provide an audio control parameter generation system that maintains a flexibility of application as well as of operation. It is a further object of the invention to provide a system and method for the production of audio control parameters for not only speech synthesis, but for many different types of sounds, such as music, backchannel and non-lexical vocalizations.

In one aspect of the invention, a method implemented on a computational learning machine is provided for producing audio control parameters from symbolic representations of desired sounds. The method comprises presenting symbols to multiple input windows of the learning machine. The multiple input windows comprise at least a lowest window and a higher window. The symbols presented to the lowest window represent audio information having a low level of abstraction, such as phonemes, and the symbols presented to the higher window represent audio information having a higher level of abstraction, such as words. The method further includes generating parameter contours and temporal scaling parameters from the symbols presented to the multiple input windows, and then temporally scaling the parameter contours in accordance with the temporal scaling parameters to produce the audio control parameters. In a preferred embodiment, the symbols presented to the multiple input windows represent sounds having various durations. In addition, the step of presenting the symbols to the multiple input windows comprises coordinating presentation of symbols to the lowest level window with presentation of symbols to the higher level window. The coordinating is performed such that a symbol in focus within the lowest level window is contained within a symbol in focus within the higher level window. The audio control parameters produced represent prosodic information pertaining to the desired sounds.

Depending on the application, the method may involve symbols representing lexical utterances, symbols representing non-lexical vocalizations, or symbols representing musical sounds. Some examples of symbols are symbols representing diphones, demisyllables, phonemes, syllables, words, clauses, phrases, sentences, paragraphs, emotional content, tempos, time-signatures, accents, durations, timbres, phrasings, or pitches. The audio control parameters may contain amplitude information, pitch information, phoneme durations, or phoneme pitch contours. Those skilled in the art will appreciate that these examples are illustrative only, and that many other symbols can be used with the techniques of the present invention.

In another aspect of the invention, a method is provided for training a learning machine to produce audio control parameters from symbolic representations of desired sounds.

The method includes presenting symbols to multiple input windows of the learning machine, where the multiple input windows comprise a lowest window and a higher window, where symbols presented to the lowest window represent audio information having a low level of abstraction, and where the symbols presented to the higher window represent audio information having a higher level of abstraction. The method also includes generating audio control parameters from outputs of the learning machine, and adjusting the learning machine to reduce a difference between the generated audio control parameters and corresponding parameters of the desired sounds.

These and other advantageous aspects of the present invention will become apparent from the following description and associated drawings.

DETAILED DESCRIPTION

Figure 1:
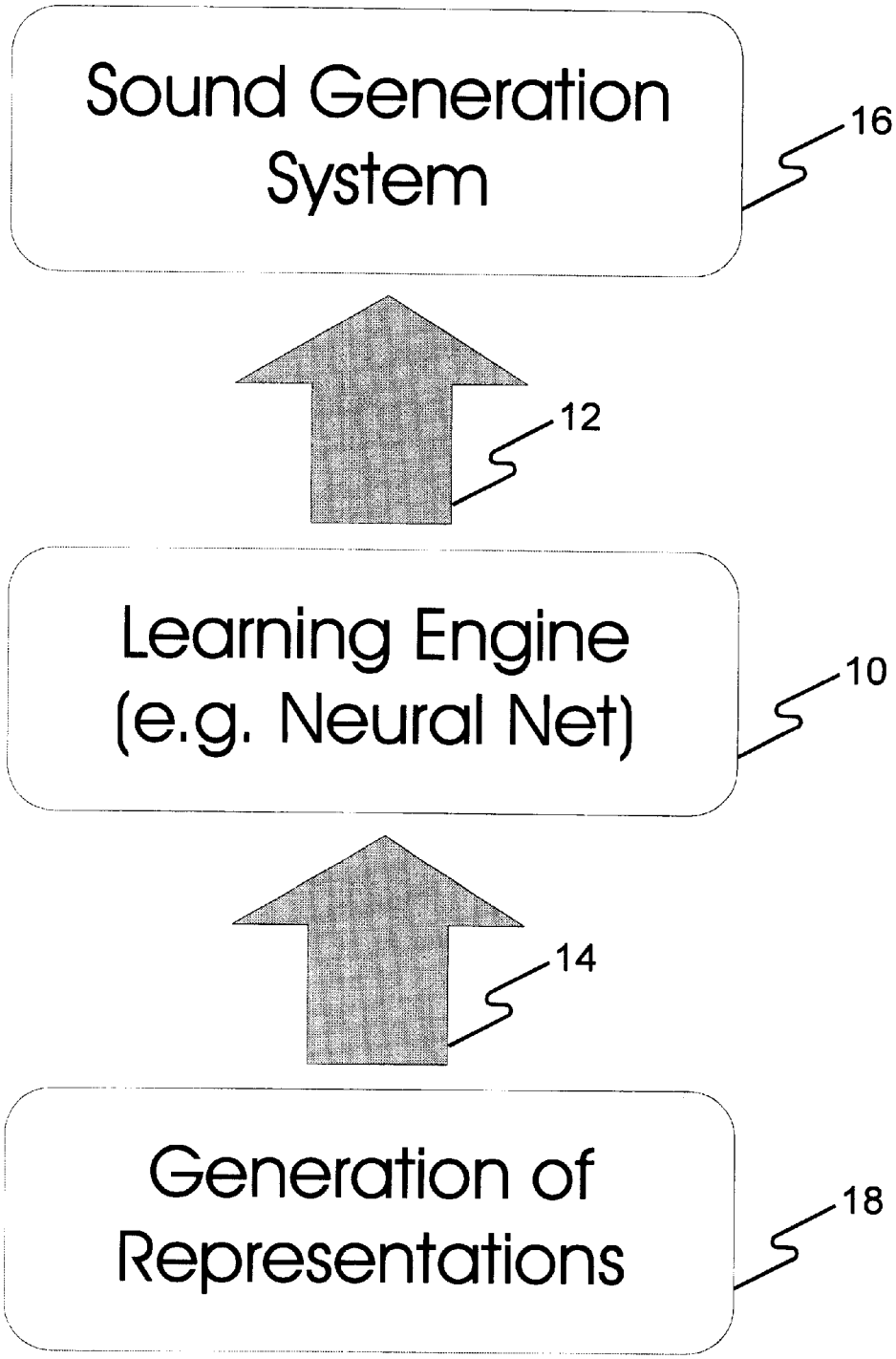
FIG. 1 is a schematic block diagram illustrating a general overview of a system for the production of audio control parameters according to a preferred embodiment of the invention.

The present invention provides a system and a method for generating a useful mapping between a symbolic representation of a desired sound and the control parameters (including parameter contours) required to direct a sound output engine to properly create the sound. Referring to FIG. 1, a learning engine 10, such as a neural network, is trained to produce control parameters 12 from input 14 comprising the aforementioned symbolic representations, and then the trained model is used to control the behavior of a sound output module or sound generation system 16. The symbolic representations 14 are produced by a representation generator 18.

At least two crucial limitations of prior learning models are solved by the system and method of the present invention. First, the problematic relationship between fixed input/output width and variable duration symbols is solved. Second, the lack of simultaneous representation of the desired sound at several different levels of abstraction is overcome. The first problem is solved in the present invention by representing the symbolic input in a time-independent form, and by using a scaling factor for adjusting the width of any output parameter contours to match the desired temporal duration of the relevant symbol. The scaling itself may be accomplished via any of a number of established methods known to those skilled in the art, such as cubic interpolation, filtering, linear interpolation, etc. The second issue is addressed by maintaining one or more largely independent hierarchical input windows. These novel techniques are described in more detail below with reference to a specific application to speech synthesis. It will be appreciated by those skilled in the art, however, that these techniques are not limited to this specific application, but may be adapted to produce various other types of sounds as well.

Further elaborating on the issue of time-independence of symbolic representations, a symbol (e.g., a phoneme or word) representing a desired sound typically lacks any indication of its exact duration. Words are familiar examples of this: "well" can be as long as the speaker wishes, depending on the speaker's intention and the word's context. Even the duration and onset of a symbol such as a quarter note on a music sheet may actually vary tremendously depending on the player, the style (legato, staccato, etc.), accellerandos, phrasing, context, etc. In contrast with prior art systems that represent their input in temporal terms as a sequence of fixed-length time segments, the input architecture used by the system of the present invention is organized by symbol, without explicit architectural reference to duration. Although information on a symbol which implies or helps to define its duration may be included in the input representation if it is available, the input organization itself is still time-independent. Thus, the input representations for two symbols in the same hierarchical input window will be the same representational length regardless of the distinct temporal durations they may correspond to.

The temporal variance in symbol duration is accounted for by producing output parameter contours of fixed representational width and then temporally scaling these contours to the desired temporal extent using estimated, generated or actual symbol durations. For example, "well" is represented by a fixed number of time-independent phoneme symbols, regardless of its duration. The prosodic, time-dependent information also has a fixed-width representation. Thus, the inputs to the learning machine always have a fixed number of symbolic elements representing sounds of various durations. The prior art techniques, in contrast, represent sounds of longer duration using a larger number of symbolic elements, each of which corresponds to a fixed duration of time. The representation of the word "well" in prior art systems thus requires a larger or smaller number of input segments, depending on whether the word is spoken with a long or short duration. This significant difference between the prior art and the present invention has important consequences. Because the present invention has a fixed number of representational symbols, regardless of the duration of the word, the learning machine is able to more effectively correlate specific inputs with the meaning of the sound, and correlate these meanings with contextual information. The present invention, therefore, provides a system that is far superior to prior art systems.

We now turn to the technique of simultaneously representing a desired sound at different levels of abstraction. A sound can often be usefully represented at many different, hierarchically-related levels of abstraction. In speech, for example, phonemes, words, clauses, phrases, sentences, paragraphs, etc. form a hierarchy of useful, related levels of representation. As in the prior art, one could encode all of this information at the same representational level, creating representations for a low-level element, such as a phoneme, which includes information about higher levels, such as what word the phoneme belongs to, what sentence the word belongs to, and so on. However, this approach taken in the prior art has severe limitations. For example, a window of low-level information that is reasonably sized (e.g., 10 phonemes) will only span a small portion of the available higher-level information (e.g., 2 words, or a fragment of a sentence). The effect is that considerable contextual information is ignored.

Figure 2:
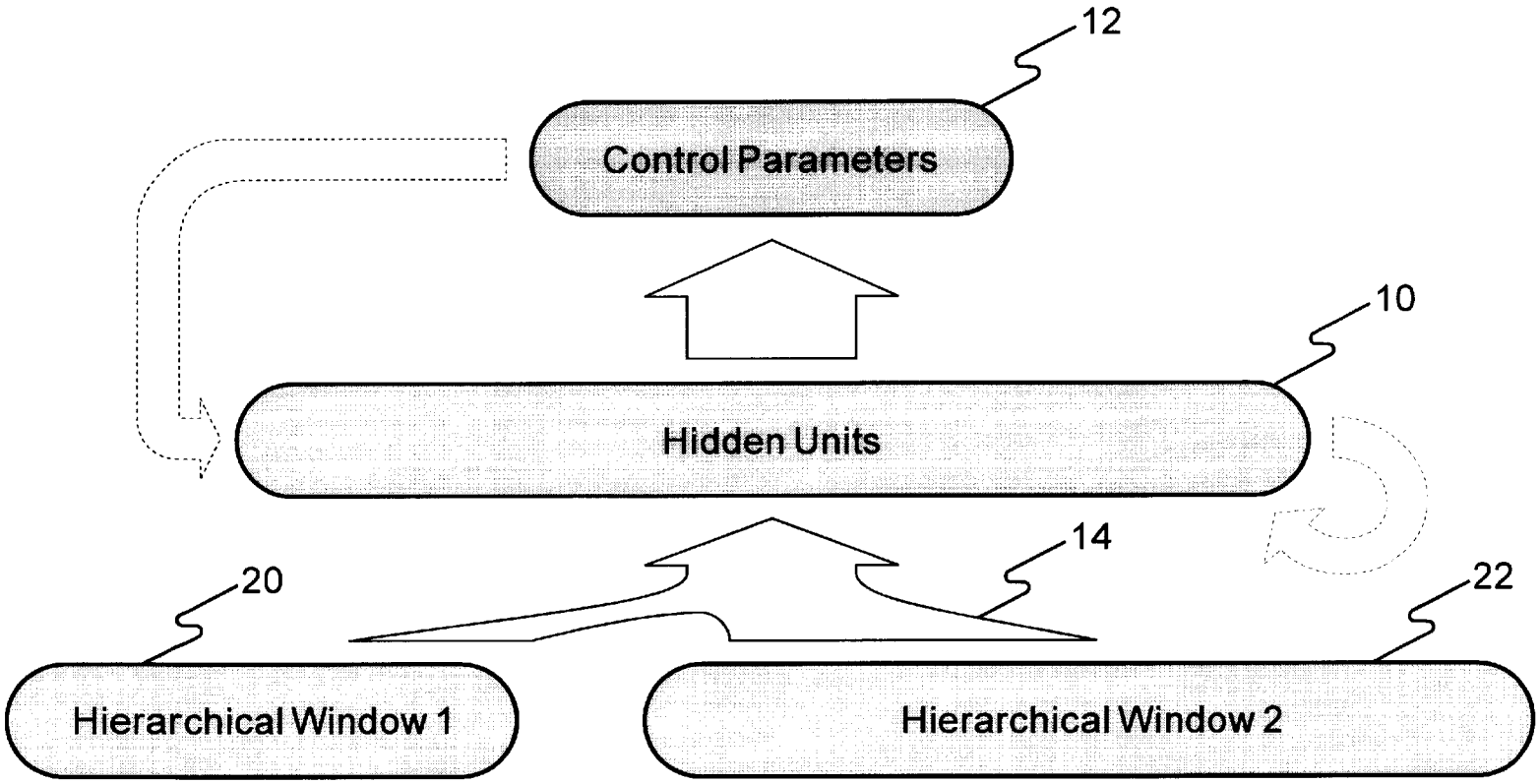
FIG. 2 is a schematic block diagram illustrating an example of a suitable learning engine for use in the system of FIG. 1.
Figure 6:
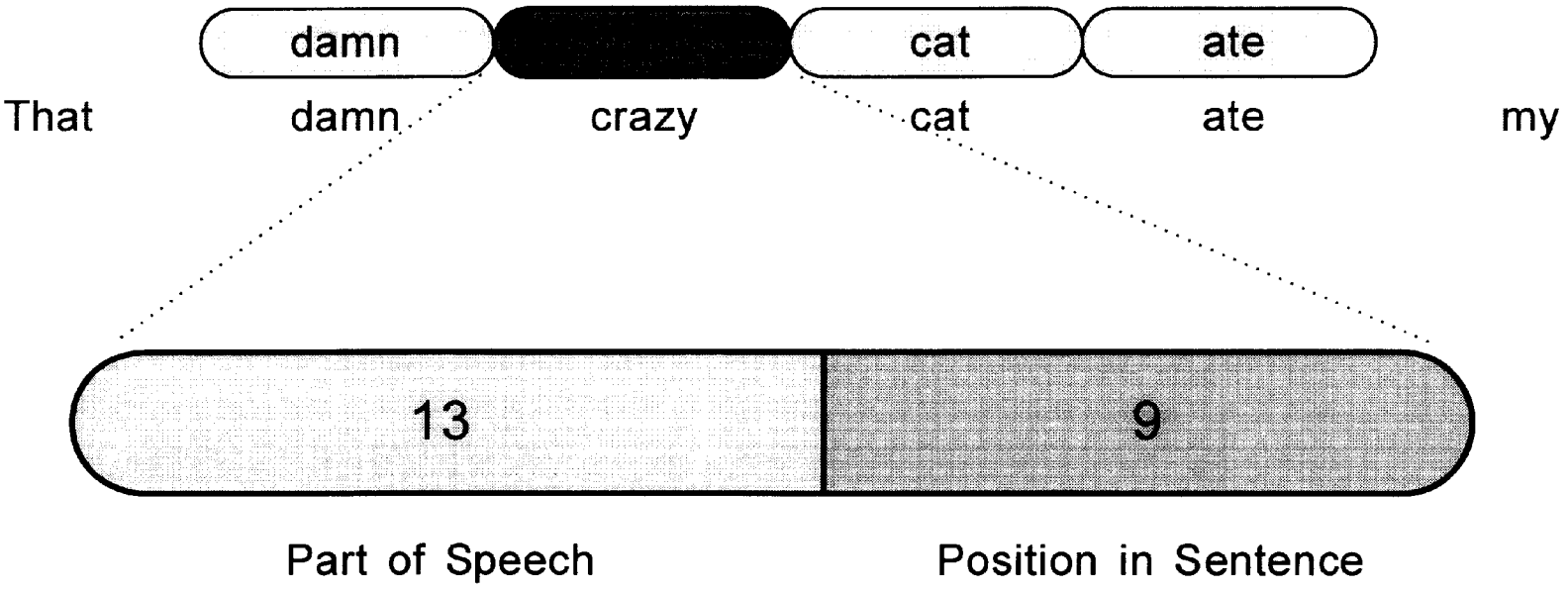
FIG. 6. is a schematic block diagram illustrating a first hierarchical input window of the learning engine of FIG. 5.
Figure 7:
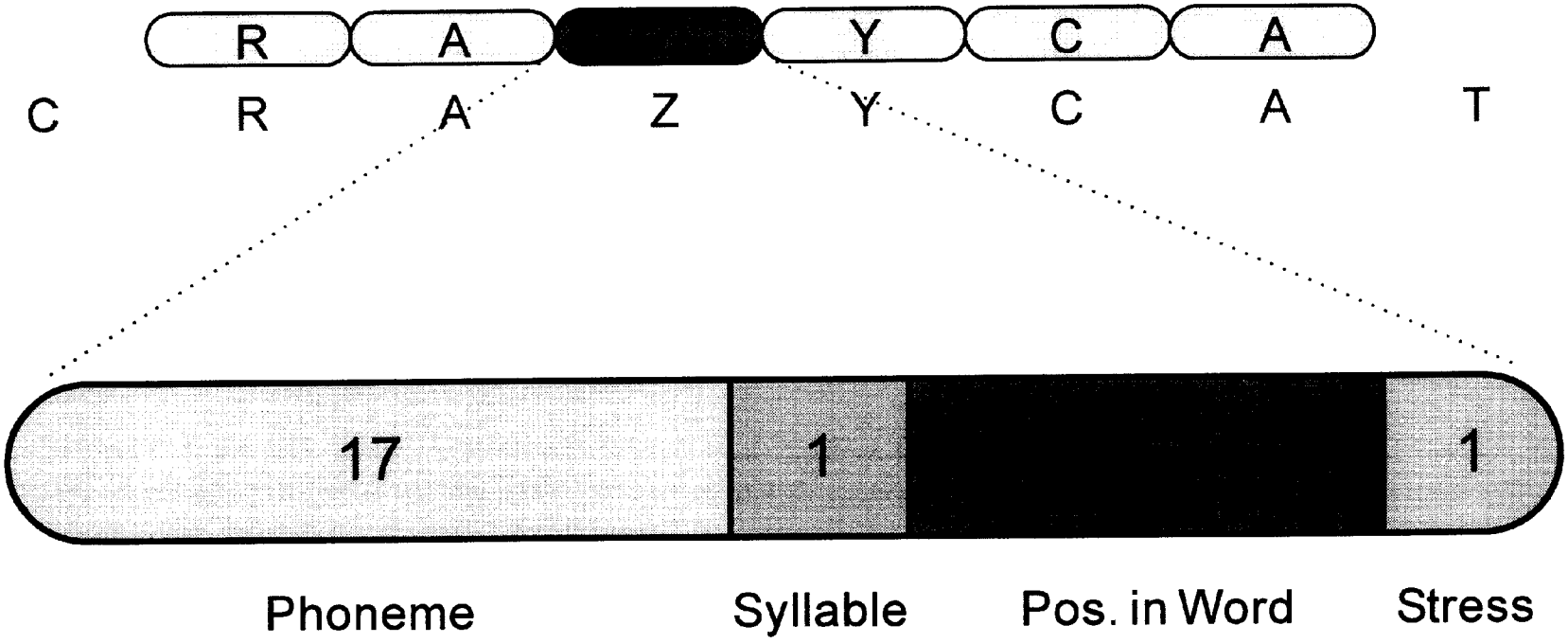
FIG. 7. is a schematic block diagram illustrating a second hierarchical input window of the learning engine of FIG. 5.

In order to simultaneously access multiple hierarchical levels of information without the restrictions and disadvantages of the prior art, the system of the present invention utilizes a novel input architecture comprising separate, independently mobile input windows for each representational level of interest. Thus, as shown in FIG. 2, a reasonably sized low-level input window 20 can be accompanied by a different, reasonably-sized window 22 at another level of abstraction. The inputs from both windows are simultaneously fed into the learning machine 10, which generates control parameters 12 based on taking both levels of information into account. For example, FIG. 6 illustrates a sequence of input elements at the level of words, while FIG. 7 illustrates a sequence of input elements at the level of phonemes. Within the window of each level is an element of focus, shown in the figures as shaded. As the system shifts its lowest-level window to focus on successive symbols (e.g., phonemes of FIG. 7), generating corresponding control parameters and parameter contours, it will occasionally and appropriately shift its higher level windows (e.g., word or phrase of FIG. 6) to match the new context. Typically, this results in windows which progress faster at lower levels of abstraction (e.g., FIG. 7) and slower at higher levels (e.g., FIG. 6), but which always focus on information relevant to the symbol for which parameters are being generated, and which always span the same number of representational elements.

In general terms, a parameter generation technique according to the present invention is practiced as follows. First, a body of relevant training data must be obtained or generated. This data comprises one or more hierarchical levels of symbolic representations of various desired sounds, and a matching group of sound generation control parameters and parameter contours representing prosodic characteristics of those sounds. Neither the input set (information on the symbolic representations) nor the output set (parameters and parameter contours) need be complete in the sense of containing all possible components. For example, several parallel systems can be created, each trained to output a different parameter or contour and then used in concert to generate all of the necessary parameters and contours. Alternately, several of the necessary parameters and contours can be supplied by systems external to the learning machine. It should also be noted that a parameter contour may contain just one parameter, or several parameters describing the variation of prosodic qualities of an associated symbol. In all cases, however, the training data collected is treated and organized so as to be appropriate for submission to the learning engine, including separation of the different hierarchical levels of information and preparation of the input representation for architectural disassociation from the desired durations. The generation of representations 18 (FIG. 1) is typically performed off-line, and the data stored for later presentation to the learning machine 10. In the case of text-to-speech applications, raw databases of spoken words are commonly available, as are software modules for extracting therefrom various forms of information such as part of speech of a word, word accent, phonetic transcription, etc. The present invention does not depend on the manner in which such training data is generated, rather it depends upon novel techniques for organizing and presenting that data to a learning engine.

Figure 3:
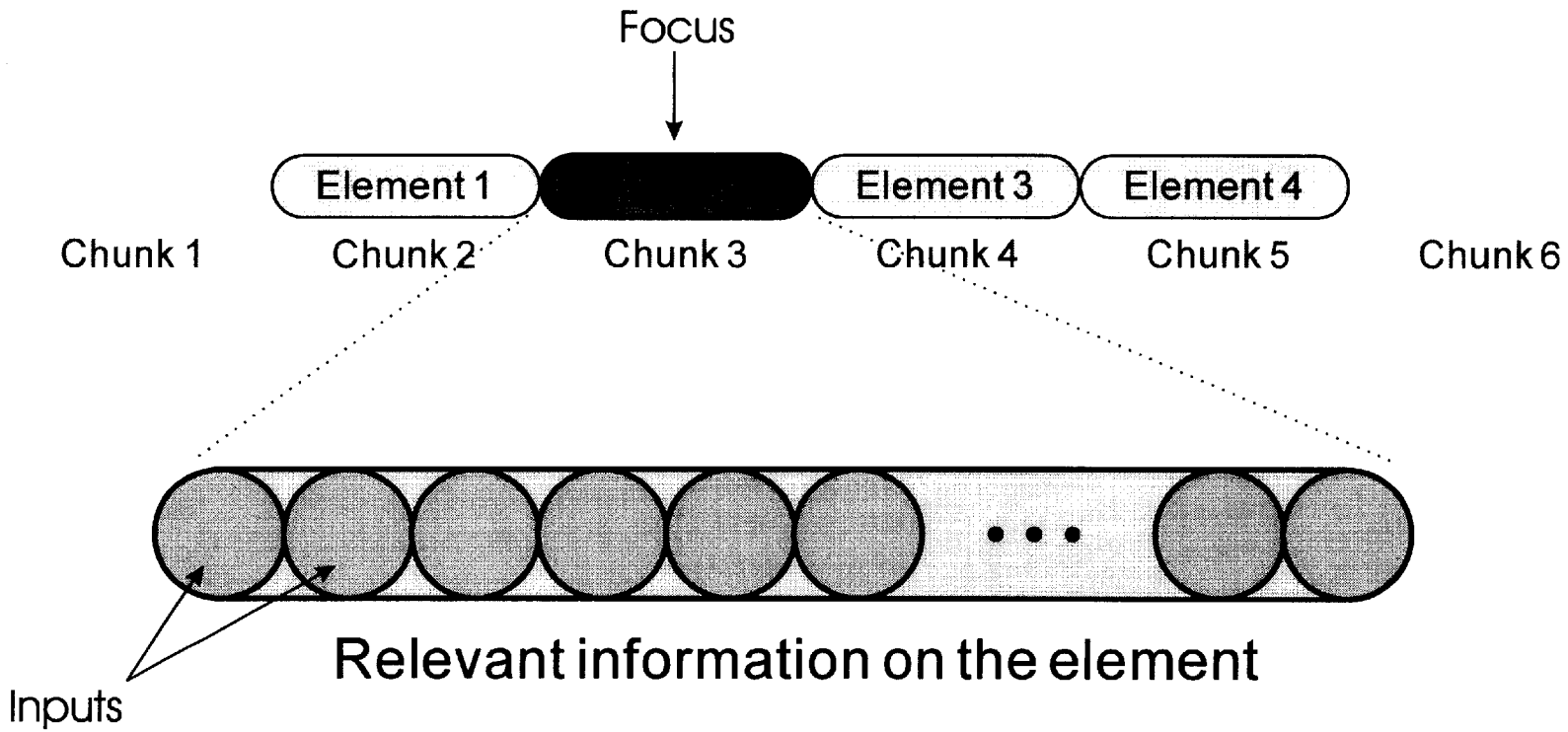
FIG. 3. is a schematic block diagram of a hierarchical input window, showing how a window of receiving elements may be applied to a stream of input symbols/representations.

Practice of the present technique includes providing a learning engine 10 (e.g., a neural network) which has a separate input window for each hierarchical level of representational information present. The learning machine 10 also has output elements for each audio generation control parameter and parameter contour to be produced. The learning machine itself then learns the relationship between the inputs and the outputs (e.g., by appropriately adjusting weights and hidden units in a neural network). The learning machine may include recurrency, self-reference or other elaborations. As illustrated in FIG. 3, each input window includes a fixed number of elements (e.g., the window shown in the figure has a four-element width). Each element, in turn, comprises a set of inputs for receiving relevant information on the chunk of training data at the window's hierarchical level. Each window also has a specific element which is that window's focus, representing the chunk which contains the portion of the desired sound for which control parameters and parameter contours are currently being generated. Precisely which element is assigned to be the focus is normally selected during the architecture design phase. The learning machine is constructed to generate sound control parameters and parameter contours corresponding to the inputs. The output representation for a single parameter may be singular (scalar, binary, etc.) or plural (categorical, distributed, etc.,). The output representation for parameter contours is a fixed-width contour or quantization of a contour.

During a training session, the learning engine is presented with the input patterns from the training data and taught to produce output which approximates the desired control parameters and parameter contours. Some of the data may be kept out of the training set for purposes of validation. Presentation of a desired sound to the training machine during the training session entails the following steps:

1. Fill the hierarchically lowest level window with information chunks such that the symbol for which control parameters and contours are to be generated is represented by the element which is that window's focus. Fill any part of the window for which no explicit symbol is present with a default symbol (e.g., a symbol representing silence).

2. Fill the next higher-level window with information such that the chunk in the focus contains the symbol which is in focus in the lowest level window. Fill any part of the window for which no explicit chunk is present with a default symbol (e.g., a symbol representing silence).

3. Repeat step 2 for each higher-level window until all hierarchical windows are full of information.

Figure 4:
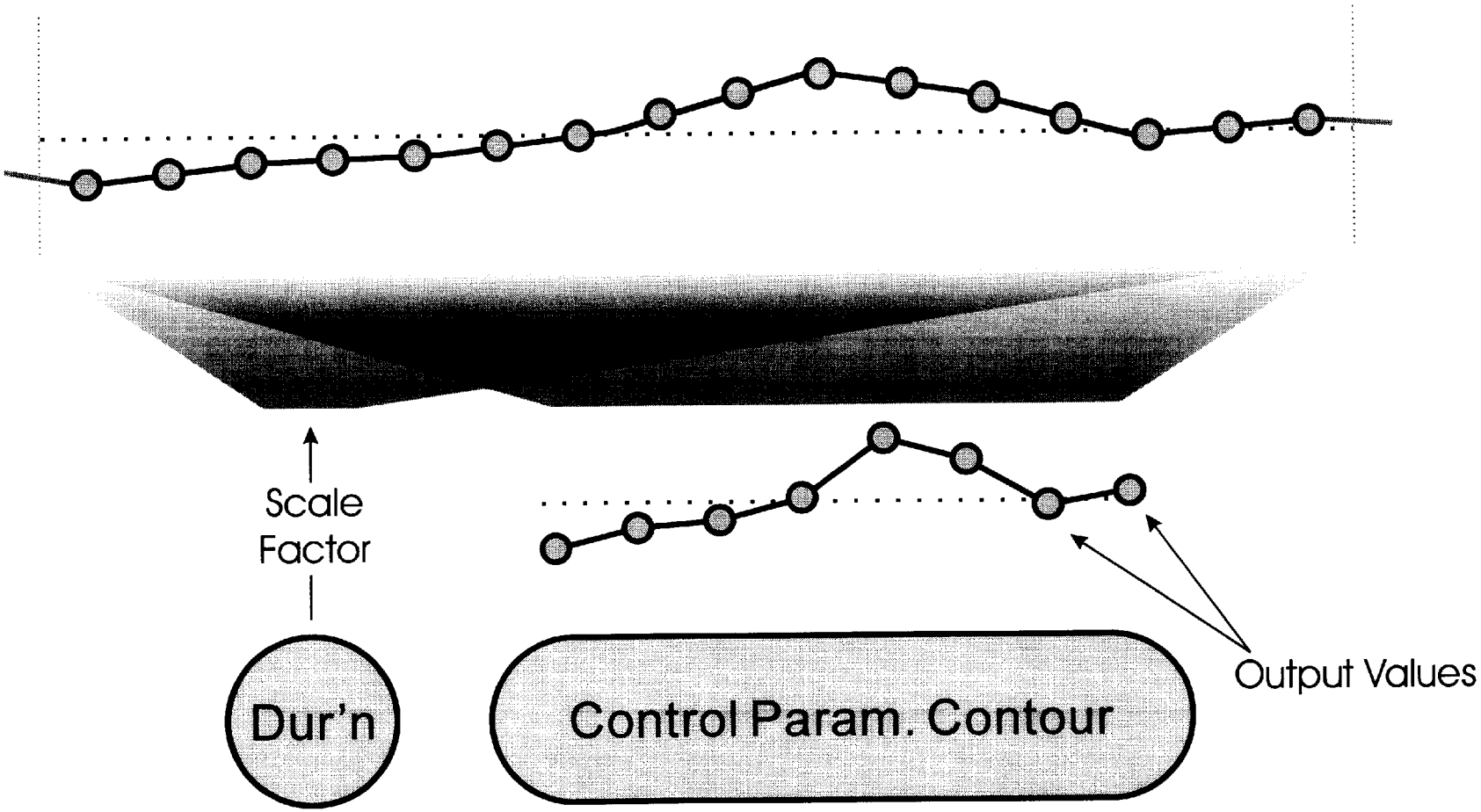
FIG. 4. is a schematic block diagram of a scaled output parameter contour showing how an output contour may be scaled to a desired width.

4. Run the learning machine, obtaining output sound generation control parameters and contours. Temporally scale any contours by predicted, actual, or otherwise-obtained durations. FIG. 4 illustrates the scaling of output values of a control parameter contour by a duration scale factor to produce a scaled control parameter contour. Alternately, the training data can be pre-scaled in the opposite direction, obviating the need to scale the output during the training process.

5. Adjust the learning machine to produce better output values for the current input representation. Various well-known techniques for training learning machines can be used for this adjustment, as will be appreciated by those skilled in the art.

6. Move the lowest level window one symbol over such that the next symbol for which control parameters and contours are to be generated is represented by the element which is that window's focus. Fill any part of the window for which no explicit symbol is present with a default symbol (e.g., a symbol representing silence). If no more symbols exist for which output is to be generated, halt this process, move to the next desired sound and return to step 1.

7. If necessary, fill the next higher window with information such that the chunk in this window's focus contains the symbol which is in focus in the lowest level window. Fill any part of the window for which no explicit chunk is present with a default symbol (e.g., a symbol representing silence).

This step may be unnecessary, as the chunk in question may be the same as in the previous pass.

8. Repeat step 7 in an analogous manner for each higher level window until all hierarchical windows are full of information.

9. go to step 4.

This process is continued as long as is deemed necessary and reasonable (typically until the learning machine has learned to perform sufficiently well, or has apparently or actually reached or sufficiently approached its best performance). This performance can be determined subjectively and qualitatively by a listener, or it may be determined objectively and quantitatively by some measure of error.

The resulting model is then used to generate control parameters and contours for a sound generation engine in a manner analogous to the above training process, but differing in that the adjustment step (5) is excluded, and in that input patterns from outside of the data set may be presented and processed. Training may or may not be continued on old or new data, interleaved as appropriate with runs of the system in generation mode. The parameters and parameter contours produced by the generation mode runs of the trained model are used with or without additional parameters and contours generated by other trained models or obtained from external sources to generate sound using an external sound-generation engine.

Figure 5:
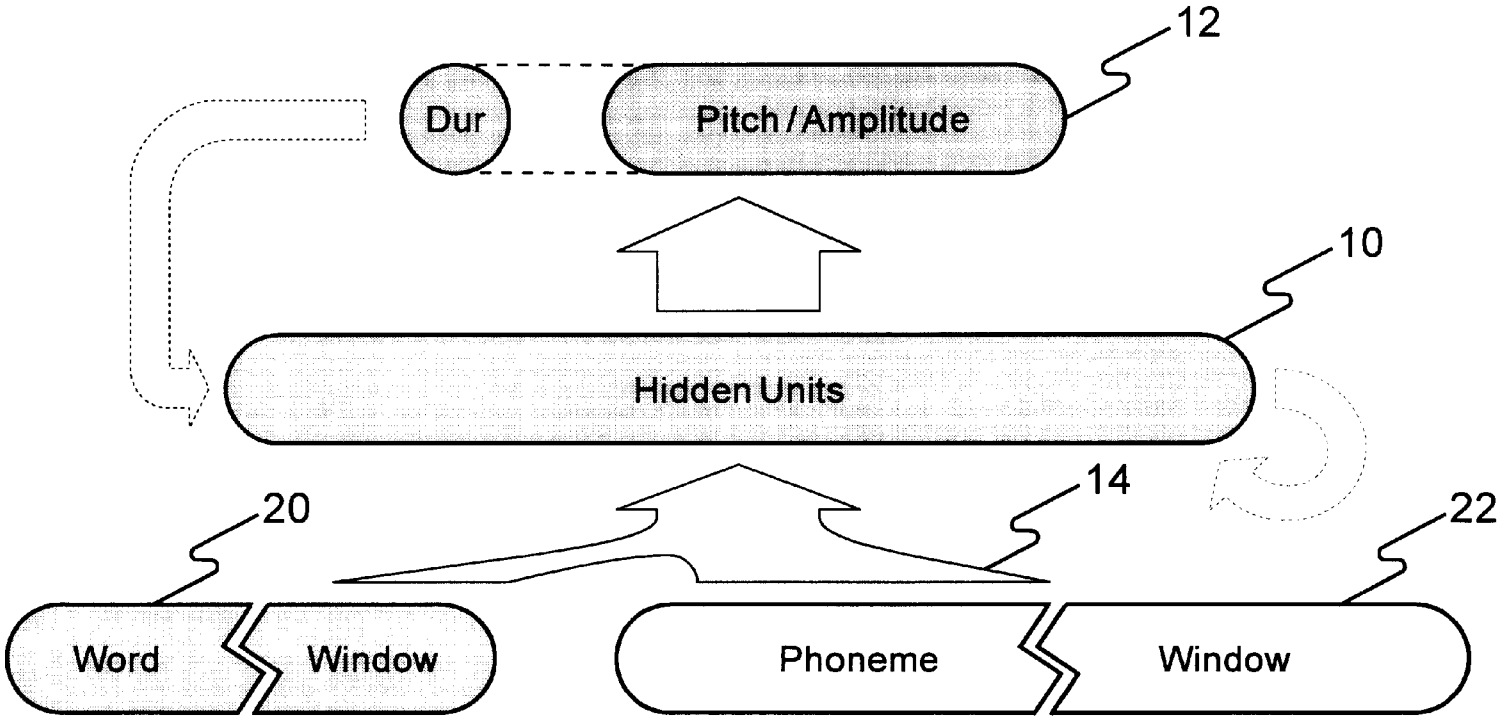
FIG. 5. is a schematic block diagram illustrating the learning engine of FIG. 2 as used in a preferred embodiment for text-to-speech synthesis.

We will now discuss in more detail the application of the present techniques to text-to-speech processing. The data of interest are as follows:

a) hierarchical input levels:
   Word level (high): information such as part-of-speech and position in sentence.
   Phoneme level (low): information such as syllable boundary presence, phonetic features, dictionary stress and position in word.

b) output parameters and parameter contours:
   Phoneme duration
   Phoneme pitch contour More sophisticated implementations may contain more hierarchical levels (e.g., phrase level and sentence level inputs), as well as more output parameters representing other prosodic information. The input data are collected for a body of actual human speech (possible via any one of a number of established methods such as recording/digitizing speech, automatic or hand-tuned pitch track and segmentation/alignment extraction, etc.) and are used to train a neural network designed to learn the relationship between the above inputs and outputs. As illustrated in FIG. 5, this network includes two hierarchical input windows: a word window 20 (a four-element window with its focus on the second element is shown in FIG. 6), and a phoneme window 22 (a six-element window with its focus on the fourth element is shown in FIG. 7). Note that the number of elements in these windows may be selected to have any predetermined size, and may be usefully made considerably larger, e.g., 10 elements or more. Similarly, as mentioned above, the foci of these windows may be set to other positions. The window size and focal position, however, are normally fixed in the design stage and do not change once the system begins training. As illustrated in FIG. 6, each element of the word window contains information associated with a particular word. This particular figure shows the four words "damn crazy cat ate" appearing in the window. These four words are part of the training data that includes additional words before and after these four words. The information associated with each word in this example includes the part of speech (e.g., verb or noun) and position in sentence (e.g., near beginning or near end). At the more detailed level, as illustrated in FIG. 7, each element of the phoneme window contains information associated with a particular phoneme. This particular figure shows the six letters "r a z y c a" appearing in the window. These six phonemes are a more detailed level of the training data. Note that the phoneme in focus, "z," shown in FIG. 7 is part of the word in focus, "crazy," shown in FIG. 6. The information associated with each phoneme in this example includes the phoneme, the syllable, the position in the word, and the stress. After these phoneme and word symbols are presented to the network input windows, the phoneme elements in the phoneme window shift over one place so that the six letters "a z y c a t" now appear in the window, with "y" in focus. Because the "y" is part of the same word, the word window does not shift. These symbols are then presented to the input windows, and the phonemes again shift. Now, the six letters "z y c a t a" appear in the phoneme window, with "c" in focus. Since this letter is part of a new word, the symbols in the word window shift so that the word "cat" is in focus rather than the word "crazy."

Figure 8:
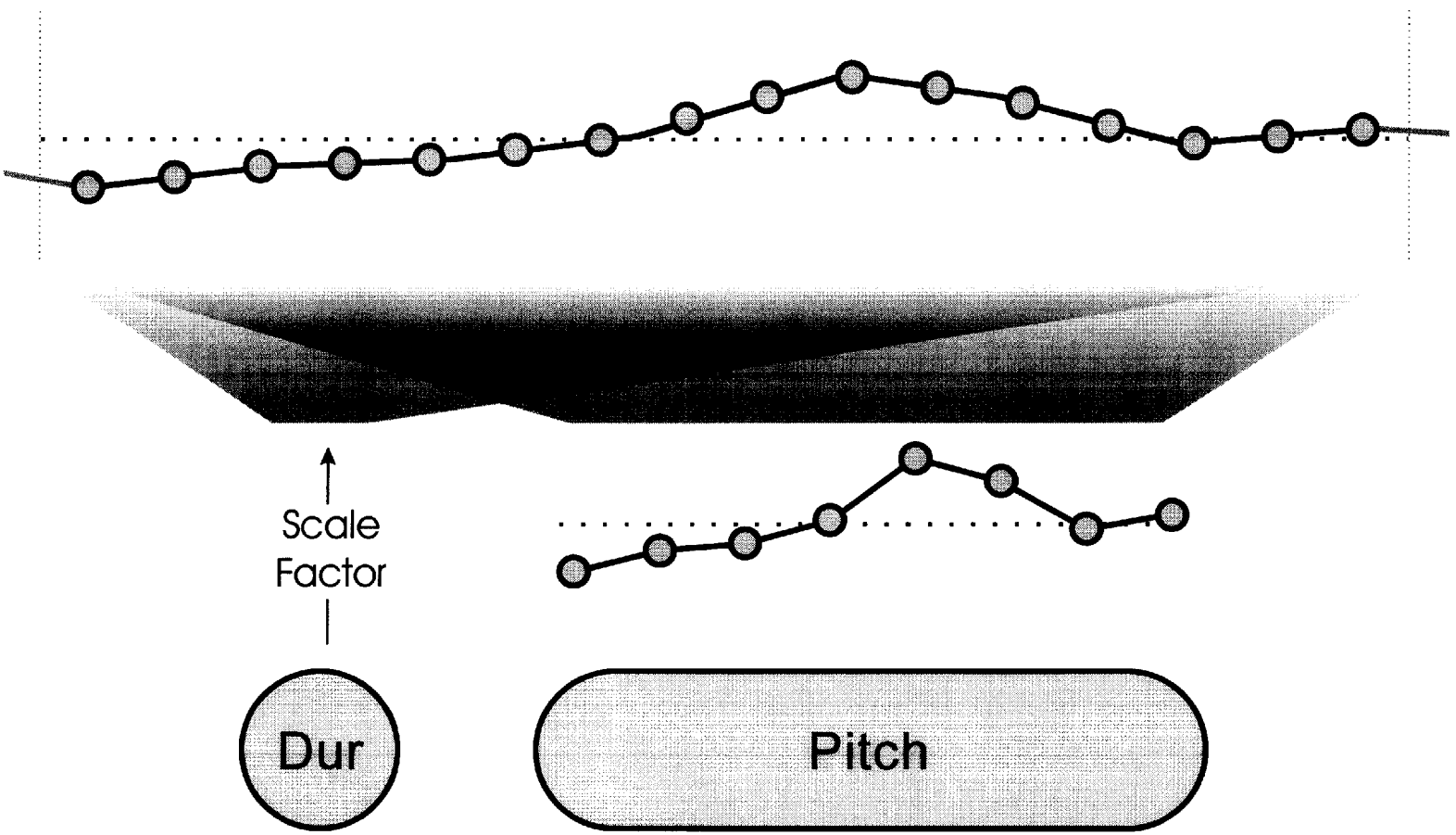
FIG. 8. is a schematic block diagram illustrating an example of parameter contour output and scaling for a text-to-speech synthesis embodiment of the invention.

The network output includes control parameters 12 that comprise a single scalar output for the phoneme's duration and a set of pitch/amplitude units for representing the pitch contour over the duration of the phoneme. FIG. 8 illustrates these outputs and how the duration is used to temporally scale the pitch/amplitude values. A hidden layer and attendant weights are present in the neural network, as are optional recurrent connections. These connections are shown as dashed lines in FIG. 5.

The network is trained according to the detailed general case described above. For each utterance to be trained upon, the phoneme window (the lowest-level window) is filled with information on the relevant phonemes such that the focus of the window is on the first phoneme to be pronounced and any extra space is padded with silence symbols. Next, the word window is filled with information on the relevant words such that the focus of this window is on the word which contains the phoneme in focus on the lower level. Then the network is run, the resulting outputs are compared to the desired outputs and the network's weights and biases are adjusted to minimize the difference between the two on future presentations of that pattern. This adjustment process can be carried out using a number of methods in the art, including back propagation. Subsequently, the phoneme window is moved over one phoneme, focusing on the next phoneme in the sequence, the word window is moved similarly if the new phoneme in focus is part of a new word, and the process repeats until the utterance is completed. Finally, the network moves on to the next utterance, and so on, until training is judged complete (see general description above for typical criteria).

Once training is considered complete, the network is used to generate pitch contours and durations (which are used to temporally scale the pitch contours) for new utterances in a manner identical to the above process, excepting only the exclusion of weight and bias adjustment. The resulting pitch and duration values are used with data (e.g., formant contours or diphone sequences) provided by external modules (such as traditional text-to-speech systems) to control a speech synthesizer, resulting in audible speech with intonation (pitch) and cadence (duration) supplied by the system of the present invention.

Note that the data used in this embodiment are only a subset of an enormous body of possible inputs and outputs. A few of such possible data are: voice quality, semantic information, speaker intention, emotional state, amplitude of voice, gender, age differential between speaker and listener, type of speech (informative, mumble, declaration, argument, apologetic), and age of speaker. The extension or adaptation of the system to this data and to the inclusion of more hierarchical levels (e.g., clause, sentence, or paragraph) will be apparent to one skilled in the art based on the teachings of the present invention. Similarly, the input symbology need not be based around the phoneme, but could be morphemes, sememes, diphones, Japanese or Chinese characters, representation of sign-language gestures, computer codes or any other reasonably consistent representational system.

We now discuss in detail an application of the invention to musical phrase processing. The data of interest are as follows:

a) hierarchical input levels:
   - Phrase level (high): information such as tempo, composer notes (e.g., con brio, with feeling, or ponderously), and position in section.
   - Measure level (medium): information such as time-signature, and position in phrase.
   - Note level (low): information such as accent, trill, slur, legato, staccato, pitch, duration value, and position in measure.

b) output parameters and parameter contours:
   - Note onset
   - Note duration
   - Note pitch contour
   - Note amplitude contour These data are collected for a body of actual human music performance (possible via any one of a number of established methods, such as recording/digitizing music, automatic or hand-tuned pitch track, or amplitude track and segmentation/alignment extraction) and are used to train a neural network designed to learn the relationship between the above inputs and outputs. This network includes three hierarchical input windows: a phrase window, a measure window, and a note window. The network also includes a single output for the note's duration, another for its actual onset relative to its metrically correct value, a set of units representing the pitch contour over the note, and a set of units representing the amplitude contour over the duration of the note. Finally, a hidden layer and attendant weights are present in the learning machine, as are optional recurrent connections.

The network is trained as detailed in the general case discussed above. For each musical phrase to be trained upon, the note window (the lowest-level window) is filled with information on the relevant notes such that the focus of the window is on the first note to be played and any extra space is padded with silence symbols. Next, the measure window is filled with information on the relevant measures such that the focus of this window is on the measure which contains the note in focus in the note window. Subsequently, the phrase window is filled with information on the relevant measures such that the focus of this window is on the phrase which contains the measure in focus in the measure window. The network is then run, the resulting outputs are compared to the desired outputs, and the network's weights and biases are adjusted to minimize the difference between the two on future presentations of this pattern. Next, the note window is moved over one note, focusing on the next note in the sequence, the measure window is moved similarly if the new note in focus is part of a new measure, the phrase window is moved in like manner if necessary and the process repeats until the musical piece is done. The network moves on to the next piece, and so on, until training is judged complete.

Once training is considered complete, the network is used to generate pitch contours, amplitude contours, onsets and durations (which are used to scale the pitch and amplitude contours) for new pieces of music in a manner identical to the above process, excepting only the exclusion of weight and bias adjustment. The resulting pitch, amplitude, onset and duration values are used to control a synthesizer, resulting in audible music with phrasing (pitch, amplitude, onset and duration) supplied by the system of the present invention.

The number of potential applications for the system of the present invention is very large. Some other examples include: back-channel synthesis (umm's, er's, mhmm's), modulation of computer-generated sounds (speech and non-speech, such as warning tones, etc.), simulated bird-song or animal calls, adding emotion to synthetic speech, augmentation of simultaneous audible translation, psychological, neurological, and linguistic research and analysis, modeling of a specific individual's voice (including synthetic actors, speech therapy, security purposes, answering services, etc.), sound effects, non-lexical utterances (crying, screaming, laughing, etc.), musical improvisation, musical harmonization, rhythmic accompaniment, modeling of a specific musician's style (including synthetic musicians, as a teaching or learning tool, for academic analysis purposes), and intentionally attempting a specific blend of several musician's styles. Speech synthesis alone offers a wealth of applications, including many of those mentioned above and, in addition, aid for the visually and hearing-impaired, aid for those unable to speak well, computer interfaces for such individuals, mobile and worn computer interfaces, interfaces for very small computers of all sorts, computer interfaces in environments requiring freedom of visual attention (e.g., while driving, flying, or riding), computer games, phone number recitation, data compression of modeled voices, personalization of speech interfaces, accent generation, and language learning and performance analysis.

It will be apparent to one skilled in the art from the foregoing disclosure that many variations to the system and method described are possible while still falling within the spirit and scope of the present invention. Therefore, the scope of the invention is not limited to the examples or applications given.

What is claimed is:

1. A method implemented on a computational learning machine for producing audio control parameters from symbolic representations of desired sounds, the method comprising:

a) presenting symbols to multiple input windows of the learning machine, wherein the multiple input windows comprise a lowest window and a higher window, wherein symbols presented to the lowest window represent audio information having a low level of abstraction, and wherein symbols presented to the higher window represent audio information having a higher level of abstraction;

b) generating parameter contours and temporal scaling parameters from the symbols presented to the multiple input windows; and c) temporally scaling the parameter contours in accordance with the temporal scaling parameters to produce the audio control parameters.

2. The method of claim 1 wherein the symbols presented to the multiple input windows represent sounds having various durations.

3. The method of claim 1 wherein presenting the symbols to the multiple input windows comprises coordinating presentation of symbols to the lowest level window with presentation of symbols to the higher level window.

4. The method of claim 3 wherein coordinating is performed such that a symbol in focus within the lowest level window in contained within a symbol in focus within the higher level window.

5. The method of claim 1 wherein the audio control parameters represent prosodic information pertaining to the desired sounds.

6. The method of claim 1 wherein the symbols are selected from the group consisting of symbols representing lexical utterances, symbols representing non-lexical vocalizations, symbols representing musical sounds.

7. The method of claim 1 wherein the audio control parameters are selected from the group consisting of amplitude information and pitch information.

8. The method of claim 1 wherein the symbols are selected from the group consisting of diphones, demisyllables, phonemes, syllables, words, clauses, phrases, sentences, paragraphs, and emotional content.

9. The method of claim 1 wherein the symbols are selected from the group consisting of tempos, time-signatures, accents, durations, timbres, phrasings, and pitches.

10. The method of claim 1 wherein the audio control parameters are selected from the group consisting of pitch contours, amplitude contours, phoneme durations, and phoneme pitch contours.

11. A method for training a learning machine to produce audio control parameters from symbolic representations of desired sounds, the method comprising:

a) presenting symbols to multiple input windows of the learning machine, wherein the multiple input windows comprise a lowest window and a higher window, wherein symbols presented to the lowest window represent audio information having a low level of abstraction, and wherein symbols presented to the higher window represent audio information having a higher level of abstraction;

b) generating audio control parameters from outputs of the learning machine; and c) adjusting the learning machine to reduce a difference between the generated audio control parameters and corresponding parameters of the desired sounds.

12. The method of claim 11 wherein the symbols presented to the multiple input windows represent sounds having various durations.

13. The method of claim 11 wherein presenting the symbols to the multiple input windows comprises coordinating presentation of symbols to the lowest level window with presentation of symbols to the higher level window.

14. The method of claim 13 wherein coordinating is performed such that a symbol in focus within the lowest level window in contained within a symbol in focus within the higher level window.

15. The method of claim 11 wherein the audio control parameters represent prosodic information pertaining to the desired sounds.

16. The method of claim 11 wherein the symbols are selected from the group consisting of symbols representing lexical utterances, symbols representing non-lexical vocalizations, symbols representing musical sounds.

17. The method of claim 11 wherein the audio control parameters are selected from the group consisting of amplitude information and pitch information.

18. The method of claim 11 wherein the symbols are selected from the group consisting of diphones, demisyllables, phonemes, syllables, words, clauses, phrases, sentences, paragraphs, and emotional content.

19. The method of claim 11 wherein the symbols are selected from the group consisting of tempos, time-signatures, accents, durations, timbres, phrasings, and pitches.

20. The method of claim 11 wherein the audio control parameters are selected from the group consisting of pitch contours, amplitude contours, phoneme durations, and phoneme pitch contours.

21. A device for producing audio control parameters from symbolic representations of desired sounds, the device comprising:

a) a learning machine comprising multiple input windows and control parameter output windows, wherein the multiple input windows comprise a lowest window and a higher window, wherein the lowest window receives audio information symbols having a low level of abstraction, wherein the higher window receives audio information symbols having a higher level of abstraction, and wherein the control parameter output windows generate parameter contours and temporal scaling parameters from the lowest level and higher level audio information symbols;

b) a scaling means for temporally scaling the parameter contours in accordance with the temporal scaling parameters to produce the audio control parameters.

22. The device of claim 21 wherein the lowest level and higher level audio information symbols represent sounds having various durations.

23. The device of claim 21 wherein a symbol in focus within the lowest level window in contained within a symbol in focus within the higher level window.

24. The device of claim 21 wherein the audio control parameters represent prosodic information pertaining to the desired sounds.

25. The device of claim 21 wherein the symbols are selected from the group consisting of symbols representing lexical utterances, symbols representing non-lexical vocalizations, symbols representing musical sounds.

26. The device of claim 21 wherein the audio control parameters are selected from the group consisting of amplitude information and pitch information.

27. The device of claim 21 wherein the symbols are selected from the group consisting of diphones, demisyllables, phonemes, syllables, words, clauses, phrases, sentences, paragraphs, and emotional content.

28. The device of claim 21 wherein the symbols are selected from the group consisting of tempos, time-signatures, accents, durations, timbres, phrasings, and pitches.

29. The device of claim 21 wherein the audio control parameters are selected from the group consisting of pitch contours, amplitude contours, phoneme durations, and phoneme pitch contours.

* * * * *